US005600902A

United States Patent [19]

Yavitz

[11] Patent Number: 5,600,902

[45] Date of Patent: Feb. 11, 1997

[54] REMOVABLE PADS FOR USE WITH SPIKED GOLF SHOES TO PROTECT PUTTING GREENS

[76] Inventor: Edward Q. Yavitz, 3828 Spring Creek Rd., Rockford, Ill. 61114

[21] Appl. No.: 539,002

[22] Filed: Oct. 4, 1995

[51] Int. Cl.[6] ..... A43B 5/00; A43B 3/16; A43B 3/12; A43B 3/10

[52] U.S. Cl. ..... 36/135; 36/7.1 R; 36/7.5

[58] Field of Search ..... 36/135, 127, 7.1 R, 36/7.3, 7.5

[56] References Cited

U.S. PATENT DOCUMENTS

| | | | |
|---|---|---|---|
| 2,076,316 | 4/1937 | Beals, Jr. | 36/7.5 |
| 2,958,963 | 11/1960 | Lougheed | 36/7.5 |
| 3,858,336 | 1/1975 | Brown | 36/7.3 X |
| 4,217,704 | 8/1980 | Whitaker | 36/7.1 R |
| 5,007,185 | 4/1991 | Lazarski | 36/135 |

OTHER PUBLICATIONS

"The Golf Course 10th Hole New Products", Golf Magazine, Oct., 1995, p. 83.

"Soft Spikes Will they stick or just fade away?", Daniels, William, Chicago District Golfer, Sep./Oct., 1995, pp. 24–27.

*Primary Examiner*—B. Dayoan

*Attorney, Agent, or Firm*—Robert A. Van Someren

[57] ABSTRACT

The article is designed for attachment to golf shoes to protect the surface integrity of putting greens on a golf course. The article includes a pad that can be removably attached to the bottom of a golf shoe to prevent conventional spikes from penetrating the surface of the green. After completion of putting, the pad can easily be removed and attached to the golfer's club bag.

5 Claims, 3 Drawing Sheets

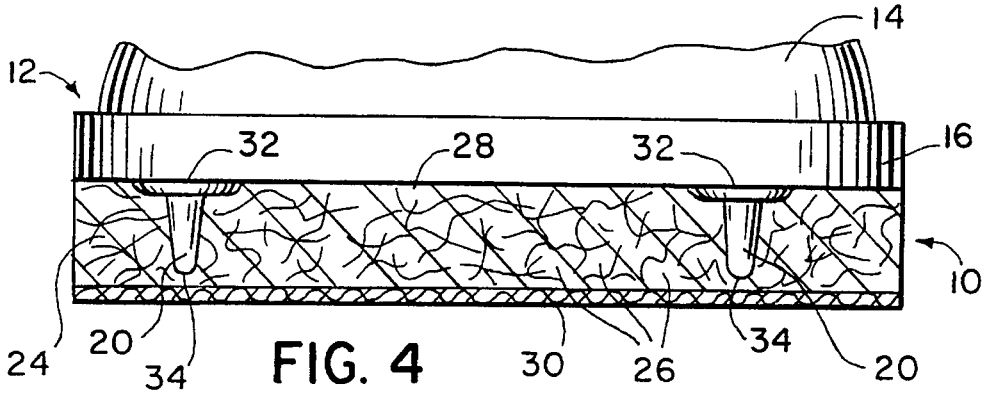
FIG. 4
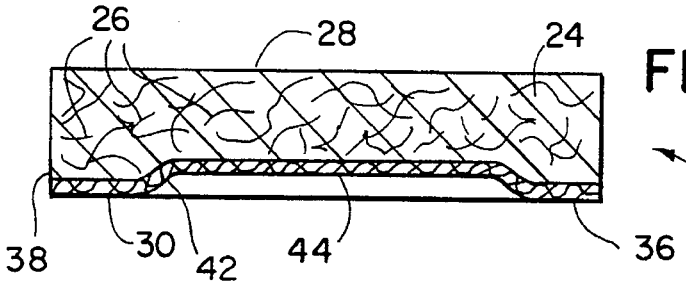
FIG. 5
FIG. 6
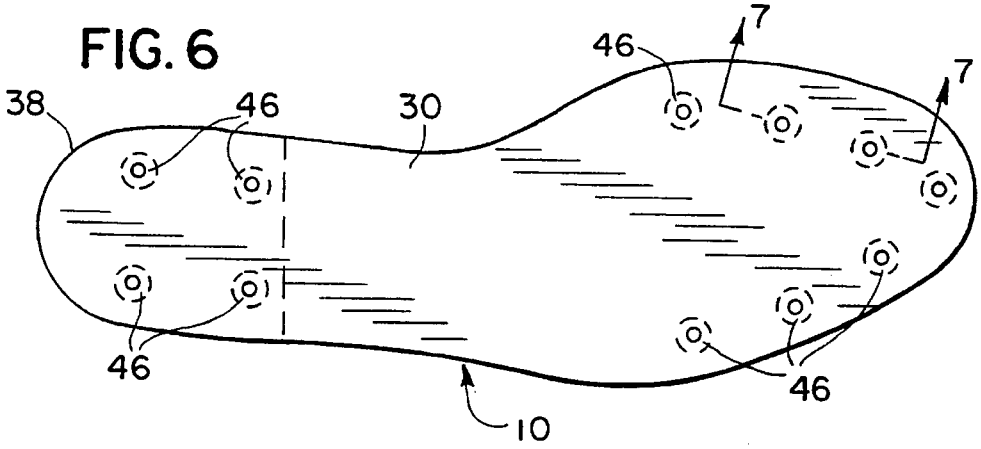
FIG. 7
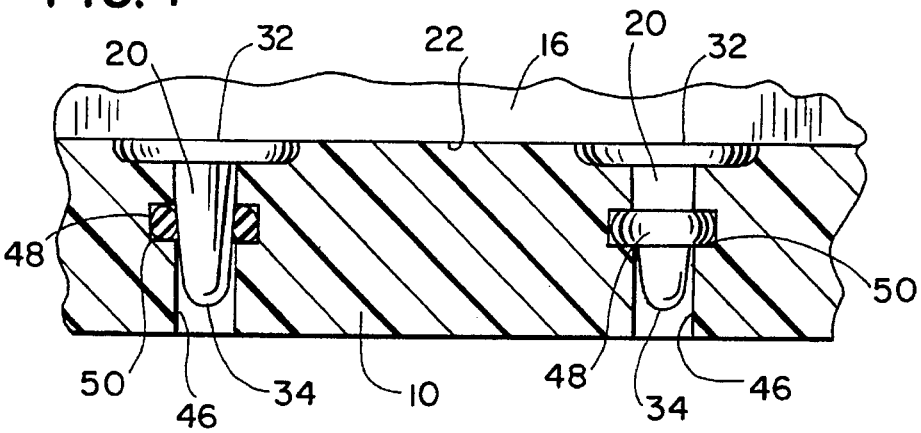

REMOVABLE PADS FOR USE WITH SPIKED GOLF SHOES TO PROTECT PUTTING GREENS

FIELD OF THE INVENTION

The present invention relates generally to articles for protecting greens on golf courses from spike marks, and particularly to articles that can temporarily be placed along the soles of golf shoes to prevent penetration of the green's surface by the golf shoe spikes during putting.

BACKGROUND OF THE INVENTION

Traditionally, golfers have worn specially designed golf shoes having metal spikes extending downwardly from the bottom of the sole. The metal spikes virtually guarantee a stable footing while the golfer is teeing off, hitting from the fairway or hitting from the rough. However, those same spikes that can be so beneficial during a golfer's approach to the green can also be extremely detrimental to the integrity of the green's surface when walked on by the golfer during putting. The constant insertion and removal of spikes into and from the putting green leaves a rough surface requiring repair. The spike marked green also creates great frustration for the next golfer whose ball may be forced off its desired line, during putting, by the marred surface. This problem is compounded by the general rules of golf which prevent golfers from repairing spike marks prior to putting.

Due to this roughening of green surfaces by steel spikes, many clubs have banned spikes from their golf courses. However, this creates a severe problem for golfers desiring a stable footing during their approach to the green.

One proposed solution to this problem is the use of what have become known as "soft" spikes. These spikes are generally plastic circular disks that have a series of raised, curvilinear ridges. The ridges extend outwardly, but not so far as to penetrate the surface of the green. Thus, the spikes are able to provide some traction during the golfer's approach to the green and do not perforate or damage the integrity of the putting green surface to the extent of regular metal spikes. However, many golfers complain that such spikes provide insufficient traction or stability during their swing.

Consequently, it would be advantageous to provide an article or device that could temporarily be attached to the bottom of a regularly spiked shoe to prevent penetration of the spikes into the green's surface during putting.

SUMMARY OF THE INVENTION

The present invention features an article for protecting greens on golf courses when walked on by a golfer. The article is configured for attachment to the bottom of a golfer's shoe, which is the type having spikes extending outwardly from the shoe's sole.

The article includes a pad having an upper surface and a lower surface. The pad is penetrable by the spikes but sufficiently cohesive to grip the spikes and remain in place during putting. The thickness of the pad is sufficient to prevent the spikes from extending substantially therethrough when stood upon by the golfer.

According to one aspect of the invention, the pad is made of a mesh material, such as a plastic mesh. In an alternate embodiment, the pad includes recesses arranged in a pattern to generally match the arrangement of at lease several of the spikes. The recesses preferably include resilient members, such as O-rings, that grip the spikes and maintain the pad in place on the bottom of the golfer's shoe during putting.

According to another embodiment of the invention, the article for preventing damage to golf course greens includes a bottom support layer that lies along the tips of the spikes. The support layer has an internal surface disposed for contact by the golf shoe spikes and an outer surface disposed to contact the green. A resilient portion, preferably in the form of a rubberized lip or ring, extends upwardly from the support layer to grip the edge of the golf shoe sole.

BRIEF DESCRIPTION OF THE DRAWINGS

The invention will hereafter be described with reference to the accompanying drawings, wherein like reference numerals denote like elements, and:

FIG. 4 is a cross-sectional view taken generally along lines 4—4 of FIG. 3;

FIG. 5 is a cross-sectional view taken generally along lines 5—5 of FIG. 2;

FIG. 6 is a bottom view of an alternate embodiment of the article according to a preferred form of the invention;

FIG. 7 is a cross-sectional view taken generally along lines 7—7 of FIG. 6;

DETAILED DESCRIPTION OF THE PREFERRED EMBODIMENT

Figure 1:
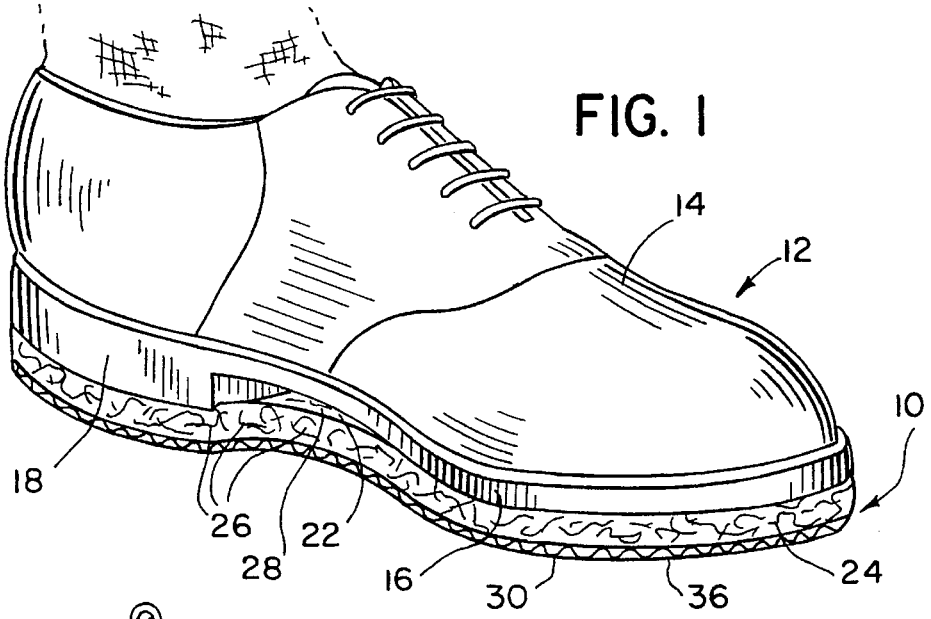
FIG. 1 is a perspective view of a golf shoe having a putting green protection article, according to a preferred form of the present invention, attached thereto.

Referring generally to FIGS. 1–5, a preferred embodiment of the invention is illustrated. Specifically, as shown in FIG. 1, an article or pad 10 is attached to a golf shoe 12. Golf shoe 12 is of the type having an upper 14 to which is attached a sole 16 that may include a heel 18. A plurality of spikes 20 (see FIGS. 3 and 4) extend outwardly or downwardly from a bottom surface 22 of sole 16.

Pad 10 can comprise a mesh material 24 that preferably includes a plurality of interlaced fibers 26. Interlaced fibers 26 are, for example, plastic fibers analogous to the plastic fibers used in making "artificial turf". However, fibers 26 must be tightly interlaced to permit penetration of spikes 20 without permitting inadvertent withdrawal of spikes 20 while the golfer wearing golf shoe 12 walks along the surface of a putting green. Thus, the golfer is able to simply place a pair of pads 10 on the ground, step onto the pads 10 to permit penetration of spikes 20, and then manually remove pads 10 from the spikes after walking off the green.

Each pad 10 has an upper surface 28 and a lower surface 30. The distance between upper surface 28 and lower surface 30 is typically generally the same as the distance between a base 32 and a distal end 34 of each spike 20. In any event, the thickness of pad 10, i.e. the distance between upper surface 28 and lower surface 30, should be sufficient to prevent substantial penetration of spikes 20 through pad 10 when the golfer walks over the green. However, depending on the desired application, the thickness of pad 10 could be somewhat less than or somewhat greater than the distance between base 32 and distal end 34 of a given golf spike 20.

Pad 10 may also include a lower layer 36 such as a layer of a woven material, e.g. cloth lower layer 36 preferably is attached, i.e. laminated, to lower surface 30 of pad 10. Pad 10 can also include a similar upper layer. The upper and lower layers assist in maintaining the integrity of mesh material 24.

In the illustrated embodiment, pad 10 has a perimeter 38 that generally matches the perimeter shape of sole 16. Additionally, a retainer 40, such as a clip, maybe attached along perimeter 38 to facilitate attachment of pad 10 to, for instance, the golfer's club bag. Lower layer 36 and retainer 40 may be attached to mesh material 24 by any of a variety of methods known to those of ordinary skill in the art, such as by a suitable adhesive.

Figure 2:
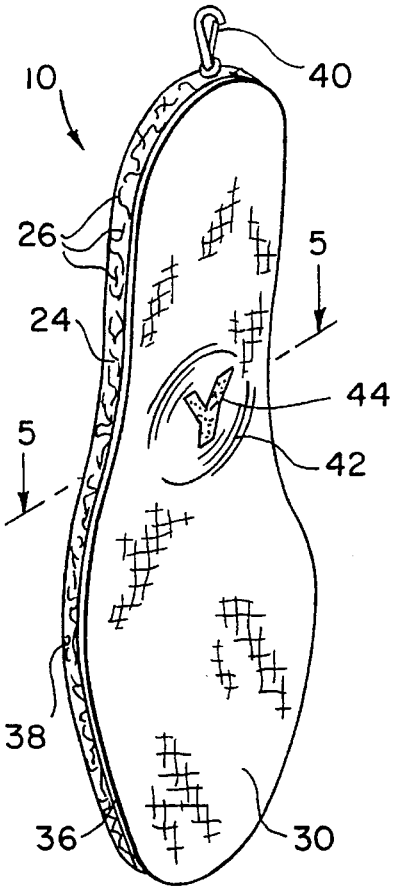
FIG. 2 is a perspective view of the article illustrated in FIG. 1.
Figure 3:
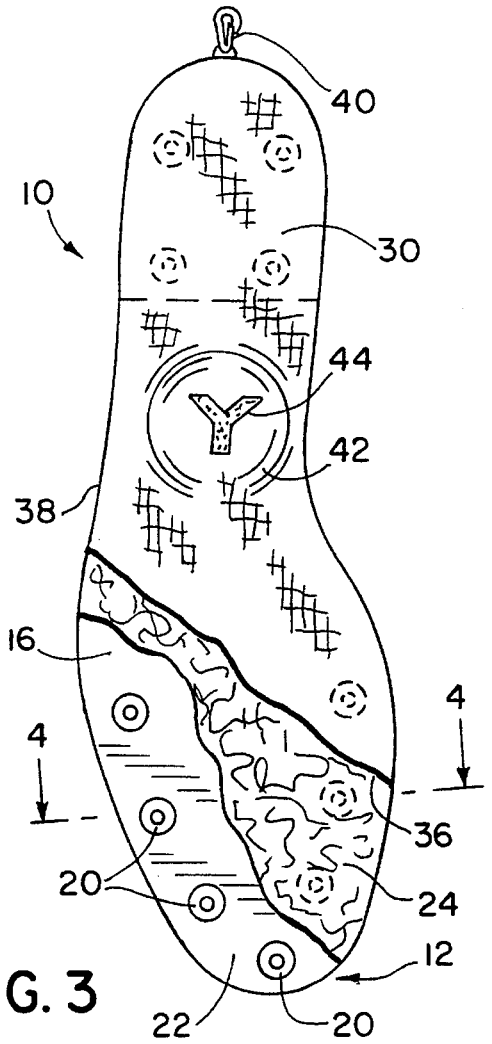
FIG. 3 is a bottom view of the golf shoe and article illustrated in FIG. 1 showing the article partially cut away.

As specifically illustrated in FIGS. 2, 3 and 5, pad 10 also includes a display area 42 on which a logo or advertisement 44 is placed. Preferably, display area 42 is slightly recessed to prevent the wear or distortion of logo 44.

An alternate embodiment of the invention is illustrated in FIGS. 6 and 7. In this embodiment, a plurality of recesses 46 are formed in or through pad 10. Recesses 46 are arranged in a predetermined pattern to match the corresponding spike pattern used by a given manufacturer of golf shoes. The recesses are appropriately sized to receive spikes 20 therein while providing a sufficiently strong friction fit to prevent spikes 20 from inadvertent withdrawal while the golfer walks across the putting green. Recesses 46 permit the use of a wide variety of materials in the making of pad 10. By way of example, the material could include cork, plastic, rubber or leather.

An additional resilient member 48 can be disposed in at least two and preferably all of the recesses 46 to further assist gripping of the corresponding spikes 20 received within the recesses. An exemplary resilient member 48 constitutes an elastomeric O-ring disposed within a corresponding annular grove 50. This arrangement is illustrated most clearly in the cross-sectional view provided in FIG. 7.

Figure 8:
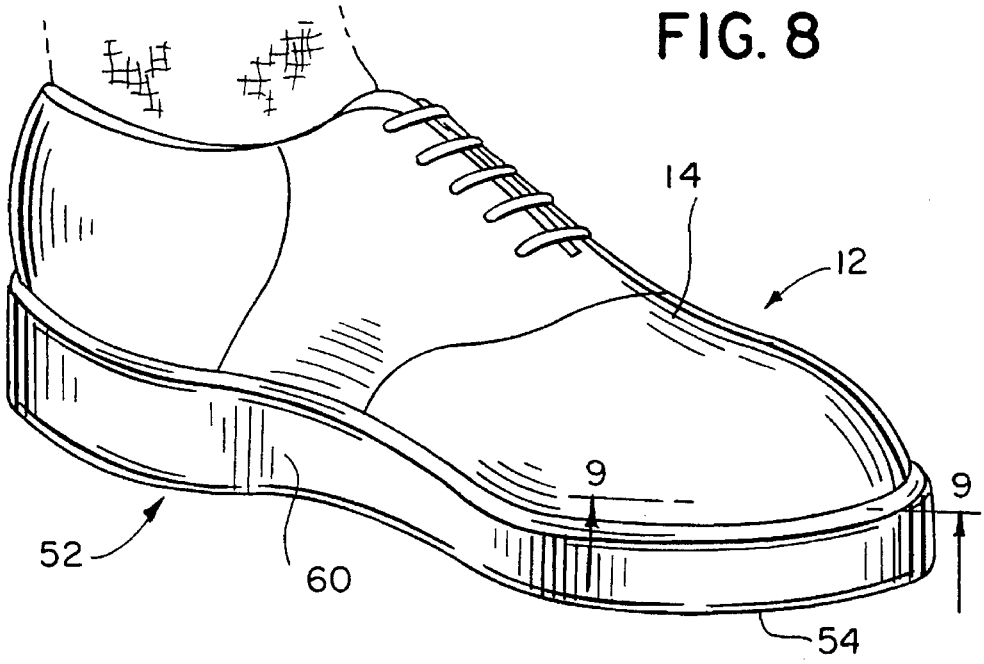
FIG. 8 is a perspective view of another alternate embodiment of the article according to a preferred embodiment of the invention, the article being attached to a golf shoe.
Figure 9:
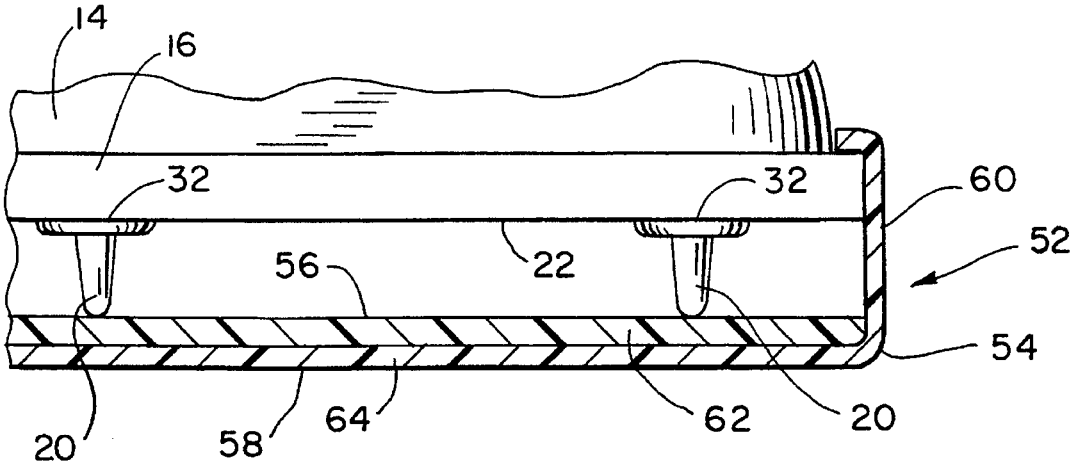
FIG. 9 is a cross-sectional view taken generally along 9—9 of FIG. 8.

Another alternate embodiment of the invention is illustrated in FIGS. 8 and 9. In this embodiment, a green protector 52 is designed to temporarily cover spikes 20 while the golfer is walking over the green during putting.

Green protector 52 includes a support layer 54 having an internal surface 56 disposed for contact by spikes 20. Support layer 54 also includes an outer surface 58 disposed to contact the green. A resilient portion or lip 60 extends outwardly from and generally transversely to internal surface 56 along at least a portion of the perimeter of support layer 54. Resilient portion 60 is preferably designed to grip the outer edge of sole 16, but can also be extended to grip both sole 16 and a portion of upper 14. Resilient portion 60 is, for example, an elastomeric material with sufficient elasticity to grip sole 60 and maintain green protector 52 in place over spikes 20 while the golfer walks along the putting green.

In the illustrated embodiment, support layer 54 includes a stiffener layer 62 that is impenetrable by spikes 20 when stood upon by the golfer. Stiffener layer 62 may be made from a variety of materials, but is preferably made from a plastic material such as vinyl. Support layer 54 can also include an additional traction layer 64 designed to provide the golfer with a more stable footing during putting. Traction layer 64 is bounded by outer surface 58 and is also suitably made from an elastomeric material. In fact, traction layer 64 and resilient portion 60 can be constructed from a unitary piece of material that extends around stiffener layer 62 as best illustrated in FIG. 9.

It will be understood that the foregoing description is of preferred exemplary embodiments of this invention, and that the invention is not limited to the specific form shown. For example, a variety of mesh materials maybe used in the pad, the overall shape and thickness of the pad can be adjusted according to the application, the pad can include a variety of laminated layers and the green protector illustrated in FIGS. 8 and 9 can include a variety of lip materials that extend either partially or entirely about the sole of the golf shoe. These and other modifications maybe made in the design and arrangement of the elements without departing from the scope of the invention as expressed in the appended claims.

What is claimed is:

1. An article for protecting putting greens on golf courses when walked on by a golfer, the article being configured for attachment to a golfer's shoe, the shoe being of the type having spikes extending outwardly from a sole of the shoe, the article comprising:

a pad having an upper surface and a lower surface, the pad being penetrable by the spikes, the pad further comprising a resilient material that grips the spikes and holds the pad in place during use, wherein the pad has a thickness sufficient to prevent the spikes from extending substantially therethrough when stood upon by the golfer, further wherein the pad has a perimeter edge, the perimeter edge being generally in the shape of the shoe's sole; and a lower layer of material laminated to the lower surface of the pad, wherein the lower layer comprises a cloth material.

2. The article as recited in claim 1, wherein the pad comprises a mesh material of interlaced fibers.

3. The article as recited in claim 2, wherein the mesh material comprises plastic fibers.

4. The article as recited in claim 1, further comprising a retainer configured to connect the pad to a golf bag.

5. The article as recited in claim 1, further comprising a display area for receiving a logo or advertisement.

* * * * *